US005682693A

United States Patent [19]

Visocky et al.

[11] Patent Number: 5,682,693

[45] Date of Patent: Nov. 4, 1997

[54] ROLL SIGN

[75] Inventors: Joseph E. Visocky, Racine; Gregory A. Bink, Caledonia, both of Wis.

[73] Assignee: Everbrite, Inc., Greenfield, Wis.

[21] Appl. No.: 677,773

[22] Filed: Jul. 10, 1996

[51] Int. Cl.[6] ..... G09F 11/12

[52] U.S. Cl. ..... 40/472; 40/524

[58] Field of Search ..... 40/472, 524

[56] References Cited

U.S. PATENT DOCUMENTS

| | | | |
|---|---|---|---|
| 1,130,084 | 3/1915 | Havens | 40/472 |
| 1,750,714 | 3/1930 | Holt | 40/524 |
| 4,827,644 | 5/1989 | Trame | 40/472 |

*Primary Examiner*—Kenneth J. Dorner
*Assistant Examiner*—Casasndra Davis
*Attorney, Agent, or Firm*—Ryan, Maki, Mann & Hohenfeldt, S.C.

[57] ABSTRACT

A roll sign has closed loop belts made up of a series of pivotally connected links for the belts to translate parallel to each other and vertically after passing over driven wheels. Grid members having grooved tracks into which menu strips slide for being lighted from behind to make information on the strips readable. The grid members have similar end portions or webs which contain a keyhole defined by a large hole intersecting a smaller hole. Each link has an attachment pin including a shank whose end is extending through an aperture in the link and a head on the shank that is disposed on a side of the link opposite from the end of the pin. A spring biases the head against the grid member. The large holes of the keyholes fit over the head so that when this is done the grid is shifted laterally against the spring force to have the small holes slide under the head to hold the grid. The leading end of a transparency sheet is attached to the belts by a sheet gripper member that has keyholes on opposite ends for engaging the pins on the links. The free end of the sheet is floating and not attached to the belts but there are clips that have keyholes for attaching to pins on the links and freely embrace the edges of the sheet to preclude bulging but allow some longitudinal movement of the sheet. Specialized grid members, stabilizing bars and other members can also be attached to the links using the cooperating keyhole and headed pins.

11 Claims, 7 Drawing Sheets

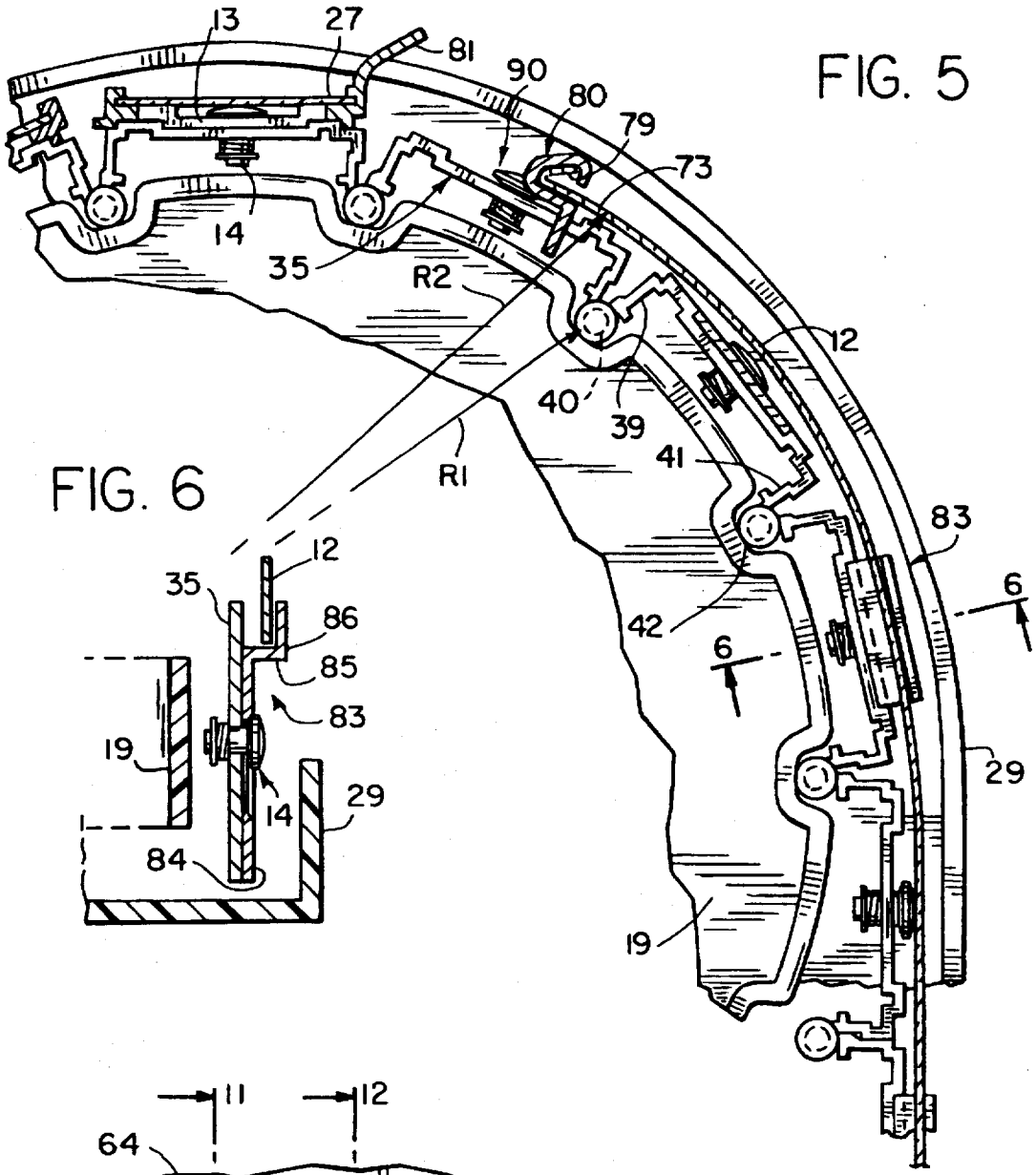
FIG. 5
FIG. 6
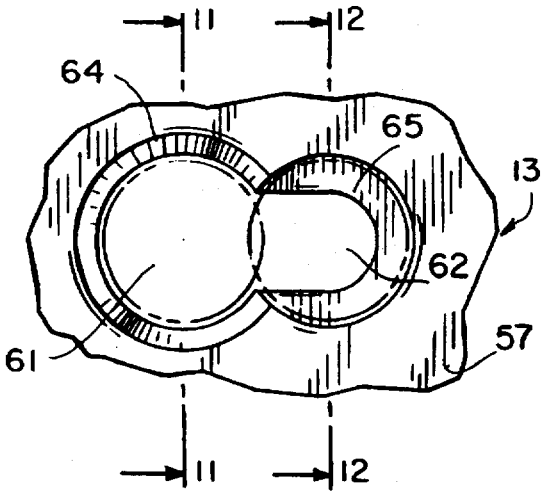
FIG. 9
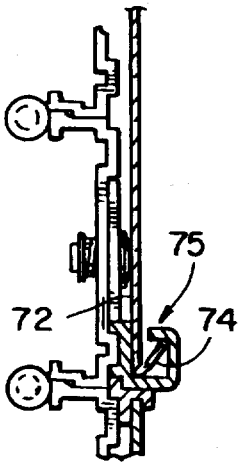

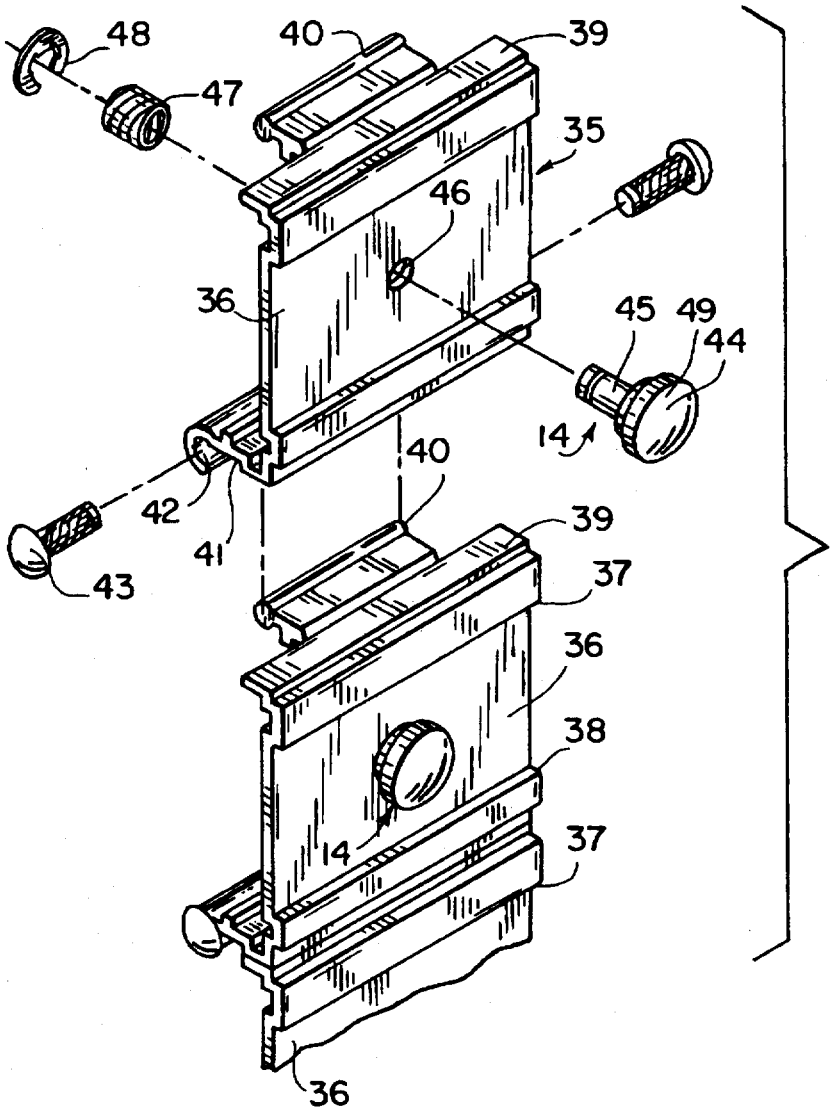
FIG. 7
FIG. 10
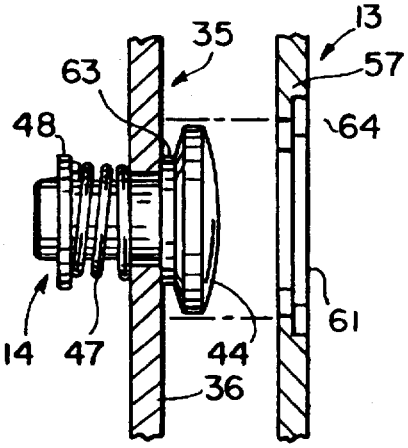
FIG. 11
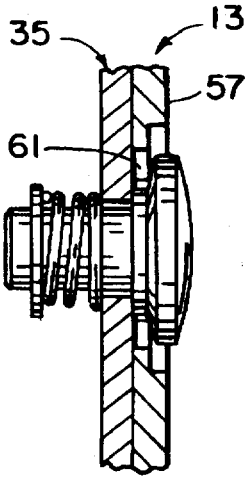
FIG. 12
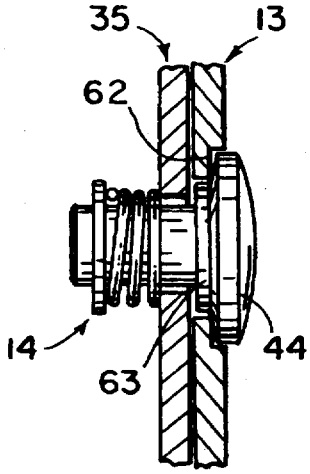

ROLL SIGN

BACKGROUND OF THE INVENTION

The invention disclosed herein pertains to a roll sign that allows displaying selected information while other information is concealed until it is selected for display.

Features of the new display sign will be illustrated in an application where the sign is being used as a menu board proximate to the drive-in window of a fast food restaurant, for example. It should be understood, however, that the new sign is versatile in that it can present different categories of information to viewers in correspondence with various circumstances. For example, in fast food restaurants, particularly at the drive-in lane, it affords an opportunity to display menu items customarily chosen by customers for breakfast, lunch, and dinner at the time of the day that relates to these meals by tradition. The sign, using known methods can be controlled remotely for changing the menus in accordance with the appropriate meal time.

An achieved objective of the new sign design is to afford the user maximum flexibility and options to display menu items and prices, for example, and to present to customers concurrently colorful transparencies depicting tantalizing menu selections or other scenes.

Another achieved objective is to not only make it possible for the user to display menu items, prices, and transparencies at the same time, but to also place the transparencies where they have the greatest impact and materiality to menu items.

Another achieved objective is to provide a roll sign that is comprised of laterally spaced apart closed loop belts which are each composed of pivotally connected link elements which provide for having grid members that span across the space between belts and are adapted for rapid insertion and exchange of strips that are backlighted to allow visualization of food items and prices for them. Another achieved objective is to conceive and implement a way to avoid overstressing in tension a transparency that is carried by the belts when the transparency goes around the drive and idler rolls for the belt loops whereupon the radius length from the axis of the rolls to the transparency is substantially greater than the radius length from the axis to the pivot points of the belt link elements.

According to the invention the new sign comprises a rotationally driven shaft and a parallel idler shaft that is spaced from the driven shaft. The driven shaft has laterally spaced apart wheel members fastened to its opposite ends the wheel members serving in the capacity serving of sprockets or gears which drive the closed looped link belts. The belts are comprised of pivotally connected link elements. Grid members in the nature of bars having elongated laterally extending open windows have their end portions adapted for quickly connecting and quickly disconnecting them to and from the laterally spaced apart belts. The belt links are used to support one or more back lighted transparencies at places selectable by the user. The leading end of a transparency remains connected to opposite but the trailing end of the transparency is not connected to the belts but is free floating.

How the foregoing objectives and features of the new sign are implemented will appear in the more detailed description of the a preferred embodiment of the invention which will now be set forth in reference to the accompanying drawings.

DESCRIPTION OF THE DRAWINGS

FIG. 5, near its top, shows how the trailing end of the transparency and stiffener has yielded along the belt as the transparency is being carried over the circular belt drive wheel;

FIG. 6 is a section taken on the line 6—6 in FIG. 5;

FIG. 7 is a perspective view of two belt links which are not presently hinged together;

FIG. 9 is a fragmentary plan view of one of the keyhole-like attachment apertures that is present in various hardware items and is used for releasably attaching items to the hinged belts; and FIGS. 10–12 show how in the new sign a typical hardware item is releasably attached to a belt link using a spring biased header attachment pin.

DESCRIPTION OF A PREFERRED EMBODIMENT

Figure 1:
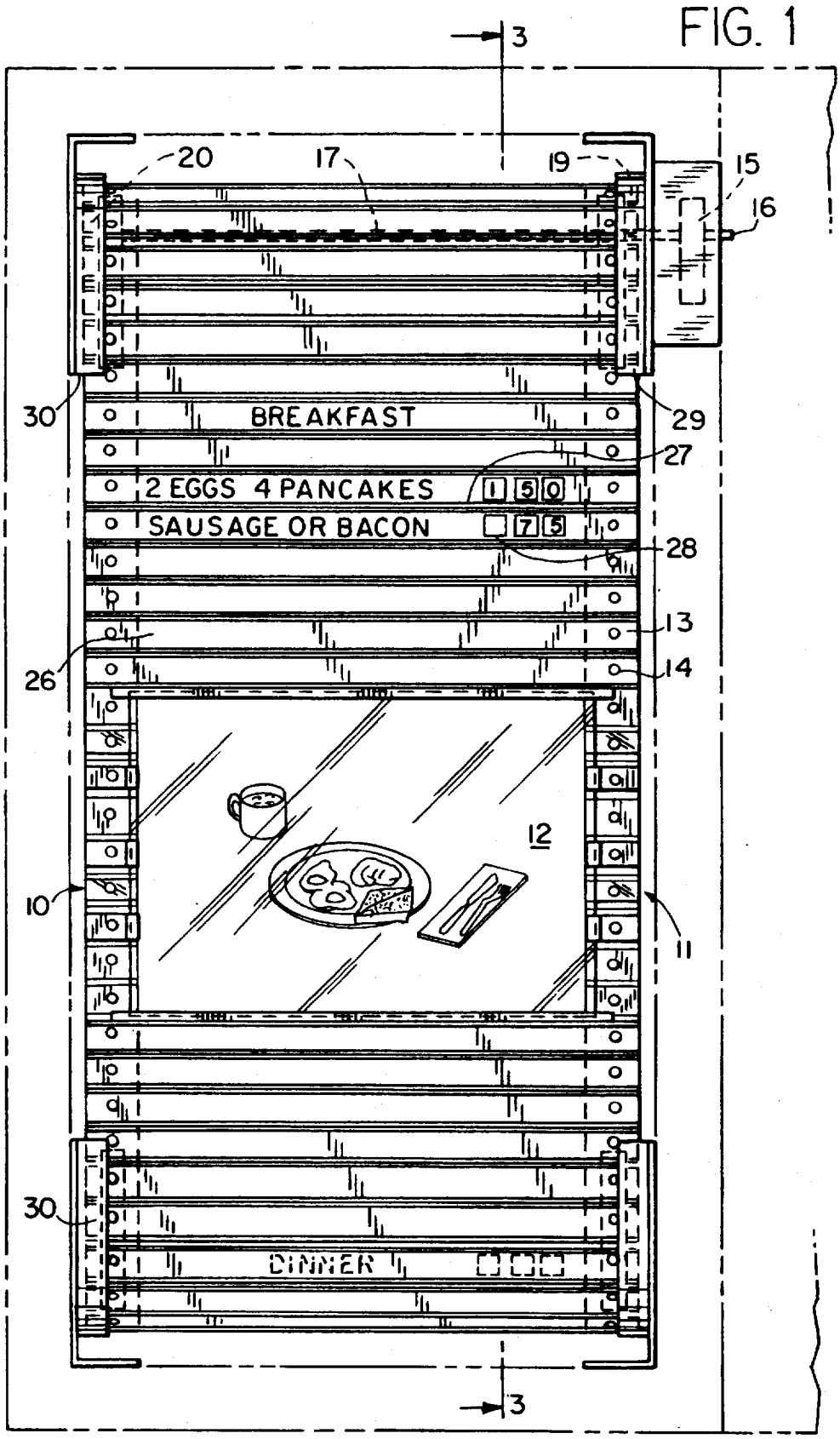
FIG. 1 is a front elevational view of the new roll sign with parts of the housing which customarily contain the sign operating components being omitted.

FIG. 1 is a front elevational view of the new roll sign with its housing omitted to exhibit some of the parts of the sign which can be viewed when the sign is in its housing and other parts which are concealed when the sign is in its housing. The sign is comprised of two laterally spaced apart link belt loops 10 and 11. Portions of the belts that are presently exposed and are shown in solid line have a pictorial sheet 12 mounted between them. The pictorial sheet could be a non-light transmissive that is illuminated from the front but is preferably a backlighted colored transparency. The word "transparency" is used herein as a generic term for either type of pictorial sheet.

Figure 3:
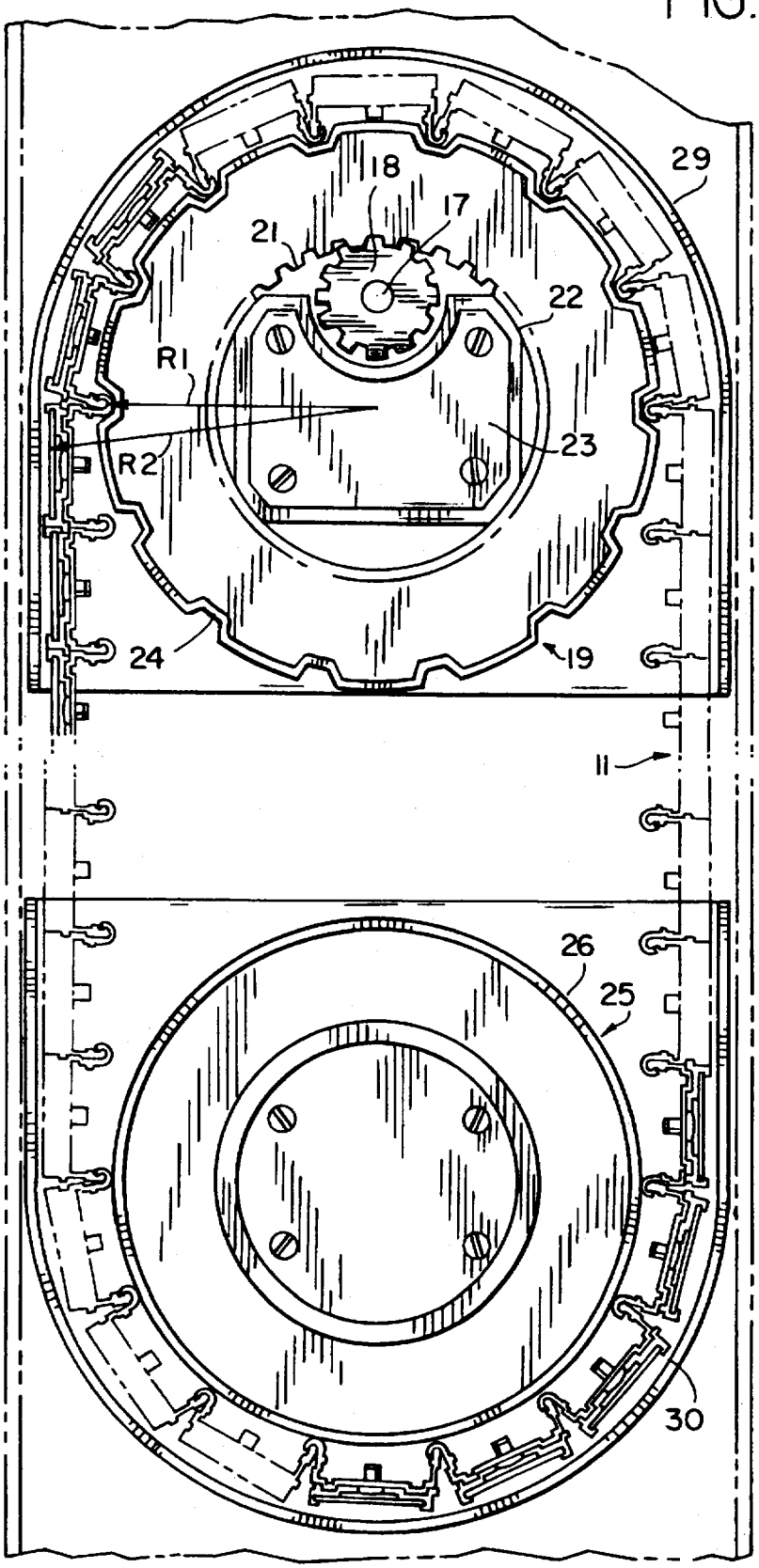
FIG. 3 depicts the drive wheel and idler wheel which transport the link belt loops.

A plurality of grids, such as the grid marked 13 are mounted detachably at their opposite ends to closed loop link belts 10 and 11 by headed spring biased attachment pins which are generally identified by the numeral 14 but whose structure and function will be described in detail later. The closed loop belts are driven with a remotely controlled electric motor 15 which has a shaft 16. As shown in FIG. 3, the motor shaft connects to a cross shaft 17 on which there are two pinions, one of which 18, is visible at the right end of the cross shaft. There are belt drive wheels 19 and 20 at opposite ends of cross shaft 17. Typical drive wheel 19 as shown in FIG. 3, has an internal gear whose teeth 21 are engaged with the teeth on drive pinion 17. The ring gear teeth are journaled on the circular corners 22 of a bearing block. Typical drive wheel 19 has equiangularly spaced apart grooves 24 to provide for being engaged by the belt 11 so the wheel 19 can drive the belt translationally. Wheel 19 is analogous to a sprocket or a gear. The term "wheel" is used herein as a generic name for a sprocket or gear as well as the wheel which is shown. The belt drive shown herein has been adopted from a roll sign described in U.S. Pat. No. 4,827,644, dated May 9, 1989. This patent is owned by the assignee of the present application. The entire disclosure is incorporated herein by reference. It should be understood, however, that a more conventional drive arrangement could be used where the wheel 19 would be directly on the cross shaft 17 and a speed reducer, not shown, could be used to change the ratio accomplished with the small pinion 18 driving the larger diameter wheel 19.

In FIG. 3 the belt loop 11 is shown running on a rotary idler 25 that has a smooth periphery so it does not engage the belt.

In FIG. 1, most of the depicted grids have blank information strips 26 slid into them for demonstration purposes. A typical one of the strips, 27, displays a menu item and a price. In the actual sign the background for the letters is opaqued and the letters are translucent to permit brightening them by backlighting. The strips 27 may be decorated by silk screening, for example. The prices of items are displayed through backlighted translucent windows 28. The actual numbers which compose prices are on thin plastic strips, not shown, which are slipped behind the backside of an information strip 27 and a grid 13.

FIGS. 1, 3, and 5 illustrate that there are hoods 29 and 30 around the drive wheel 19 and idler wheel 25. These hoods are not visible to a viewer of the sign when the sign is in its housing, which is represented by phantom lines. It is only the front vertical run of the sign that can be read by an observer although the grids 13 and their information strips 27 could be organized in a manner such that information visible from the front of the side could also be visible from the rear.

Attention is now invited to FIG. 7 for a detailed description of the links which compose the closed loop belts 10 and 11. Each link 35 is comprised of a planar body portion 36 bordered by ledges 37 and 38. Body portion 36 serves as a seat for the end portion of one of the grids 13 which will be discussed after the links in FIG. 7 are described. Using the uppermost link 35 in FIG. 7 as typical, one may see that a link has a rearward extension 39 that terminates in an integral cylinder constituting a pivot axle 40. The link also has a rearward extension 41 that terminates in a hook-like socket 42. Socket 42 is longer in the lateral direction than is axle 40. The axle on one link slides endwise into the socket of the next link to create a hinge joint for connecting a series of links together as a closed loop belt which can negotiate the turn around wheels 19 and 25. To prevent axles 40 from sliding out of sockets 42, headed drive pins 43 are driven into opposite ends of socket 42 as far as is required for the tips of pins 43 to nearly touch the ends of axles 40 with little clearance so sideways free play is minimized. A link 35 is provided with a spring biased pin 44 for releasably connecting the end of a grid 13 to a belt link 35 as will be elaborated later. The shank 45 of pin 44 extends through hole 46 in body portion 36. A coil spring 47 fits onto the shank 45 of the pin and is compressed slightly by a c-ring 48 to provide for the c-ring to engage groove 49 of the pin shank to retain the spring. The spring pulls the head 49 of the pin for the planar seat of link 35. Links 35 used in an actual embodiment of the sign consists of extruded aluminum.

Figure 2:
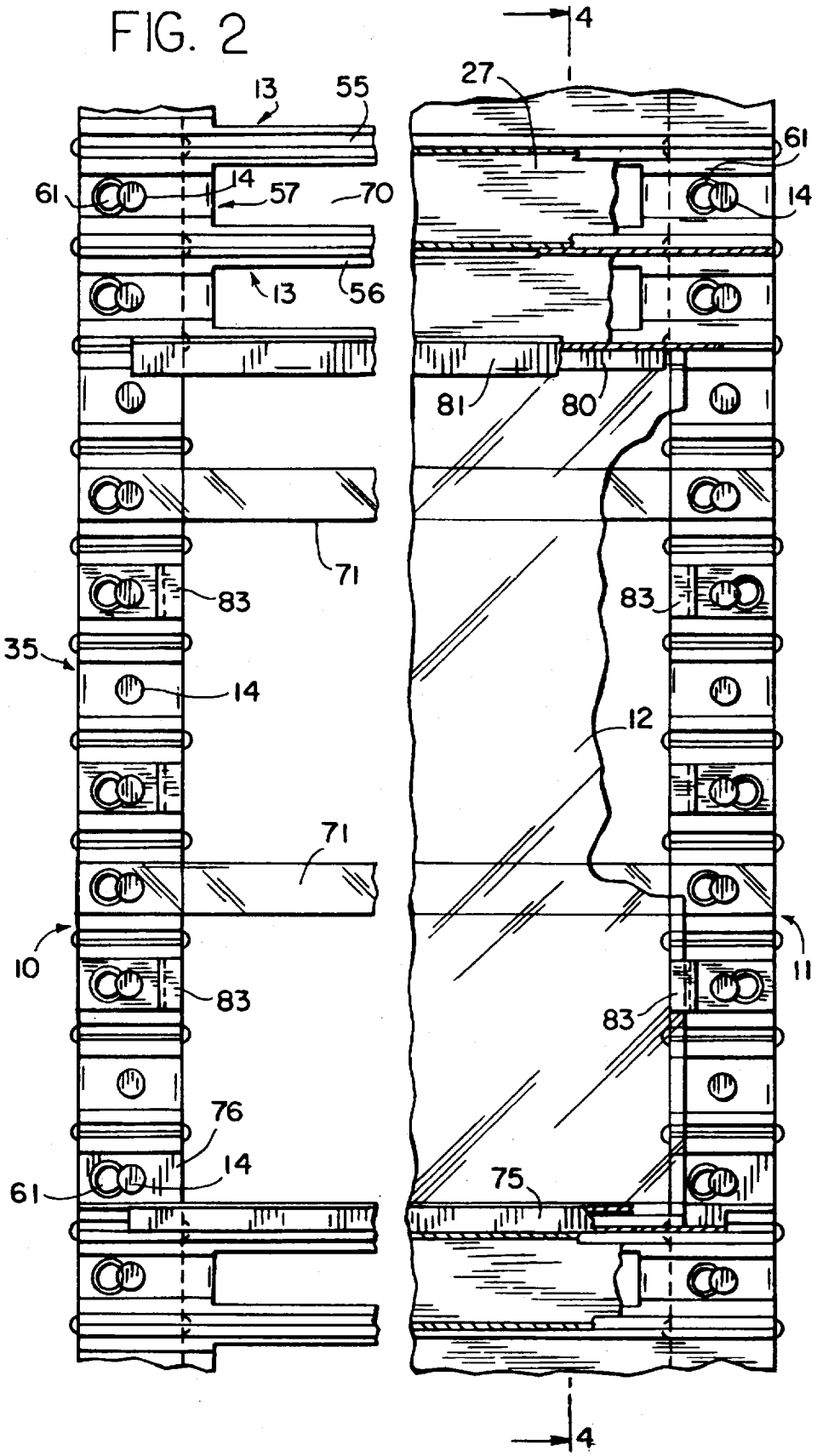
FIG. 2 is a partial or fragmentary front elevational view of two laterally spaced apart linked belts with some grids containing menu item strips installed and with a transparency installed.
Figure 8:
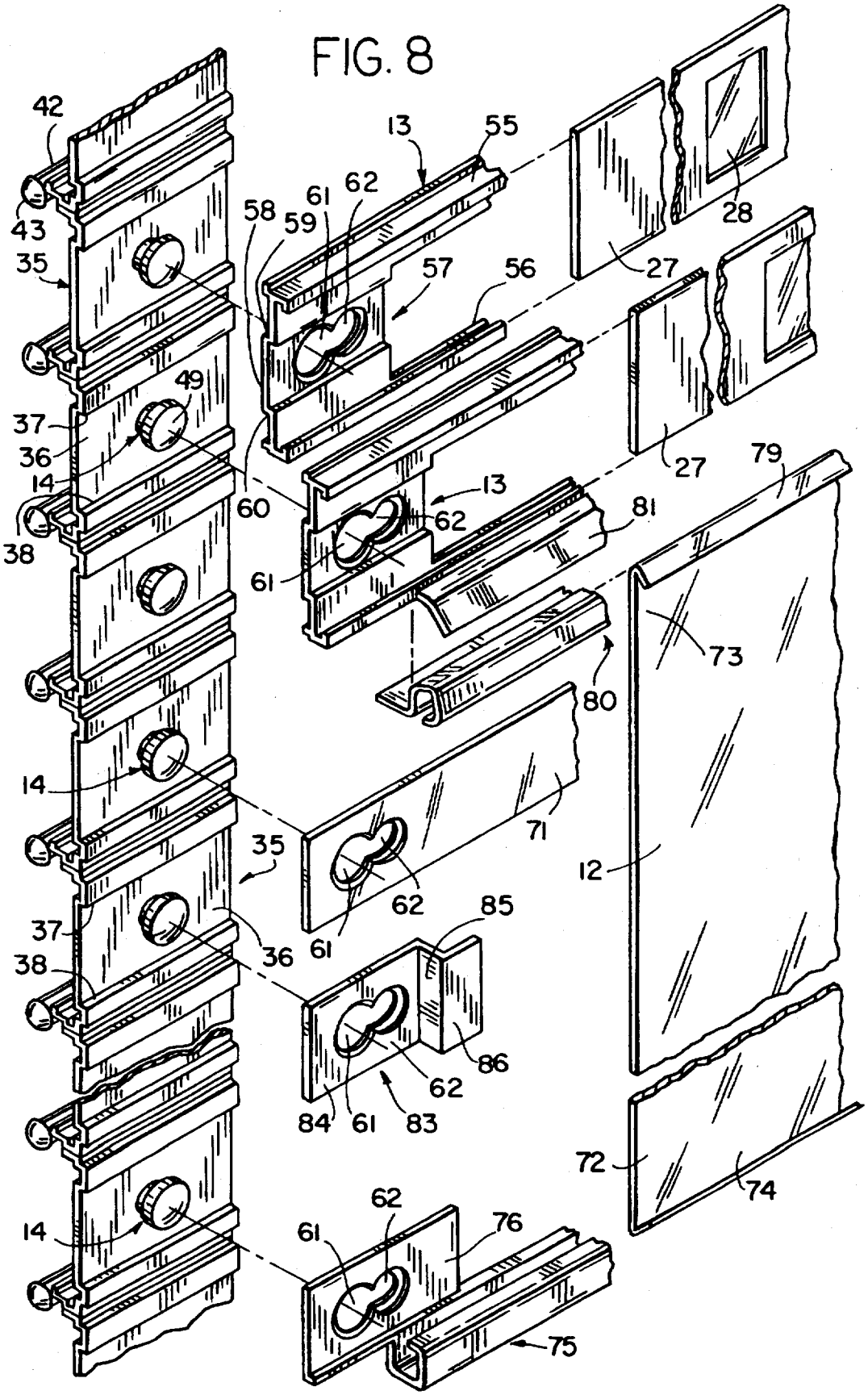
FIG. 8 is a front elevational perspective view of a series of hingedly connected belt links and an associated hardware together with a transparency that cooperates with the belt.

One of the grids 13 is shown in detail in the upper region of FIG. 8. Grids 13 can be releasably attached to any of the belt links 25. The grids 13 are constructed identically at opposite ends so the left end of one grid shown in FIG. 8 is adequate for revealing a structure. Grid 13 is a single piece aluminum extrusion, preferably. It is comprised of parallel laterally extending and longitudinally spaced apart cross bar members 55 and 56. The ends of the cross bar members are joined by a web 57. The median region 58 is configured with shoulders 59 and 60 which fit snugly between ledges 37 and 38 of a link 35 so the grid cannot move relative to the belt link when the belt is driven. As shown in FIGS. 8 and 9, the left end portion of grid 13 has two intersecting holes 61 and 62 which are for releasably attaching a grid 13 to opposite belts 10 and 11 by utilizing header pins 14. The holes 61 and 62 can be called a keyhole collectively. A similar pair of intersecting holes 61 and 62 are present on the opposite end of the grid as shown in FIG. 2, for example. At both ends of the grid 13, the large hole must be on the same side of the small hole 62. The large hole 61 fits over the head 49 of a pin 14 and the small hole 62 fits under the head. To install a grid 13 on belts 10 and 11, the user places the grid on corresponding links of opposite belts such that the large holes 61 at both ends of the grid fit over the heads 49 of the pins 14. Web 57 of the grid 13 then interfaces with seating surface 36 on the belt links 35. The user then shifts the grids sideways for the margins of the small holes 62 in the keyhole to slide under the pin heads 49.

FIG. 10, 11, and 12 show the details of the pins 14 for attaching the grids 13 and also show the keyholes on web 57 of a grid. In FIG. 10, large hole 61 on grid web 57 is aligned with head 49 of pin 14. The pin has an integral spacer collar 63 which stops the pin head 49 from being pressed directly against the planar surface 36 of grid 13 by spring force but leaves a small clearance space. The large hole 61 has a beveled margin 64. In FIG. 11 the large hole 61 is fitted over head 49 of the pin and link 35 and grid 13 are interfaced. In FIG. 12, the grid has been shifted sideways so the rim of the small hole 62 in web 57 of the grid slides under the pin head 49. Spring 47 has now increased loading which firmly secures grid 13 on link 35.

FIG. 2 shows a part of a closed loop sign assembly where belts 10 and 11 are formed by hooking belt links 35 together. In the upper region of the assembly, a typical grid 13 is attached at opposite ends to the belts using pins 14. The attached cross bars 55 and 56 of the grid and web 57 of the grid define an open window 70 through which light from fluorescent tubes in the housing, not shown, can pass for backlighting menu strips or other information strips 27. To assure that the belts 10 and 11 stay parallel with each other, spacer bars 71 are fastened periodically to corresponding links on laterally separated belts 10 and 11 using pins 14. FIGS. 2 and 11 show that bars 71 have keyholes at opposite ends to provide for releasably attaching the bars to belt links 35 in the manner in which grids 13 are releasably connected to the belt link as described earlier.

Figure 4:
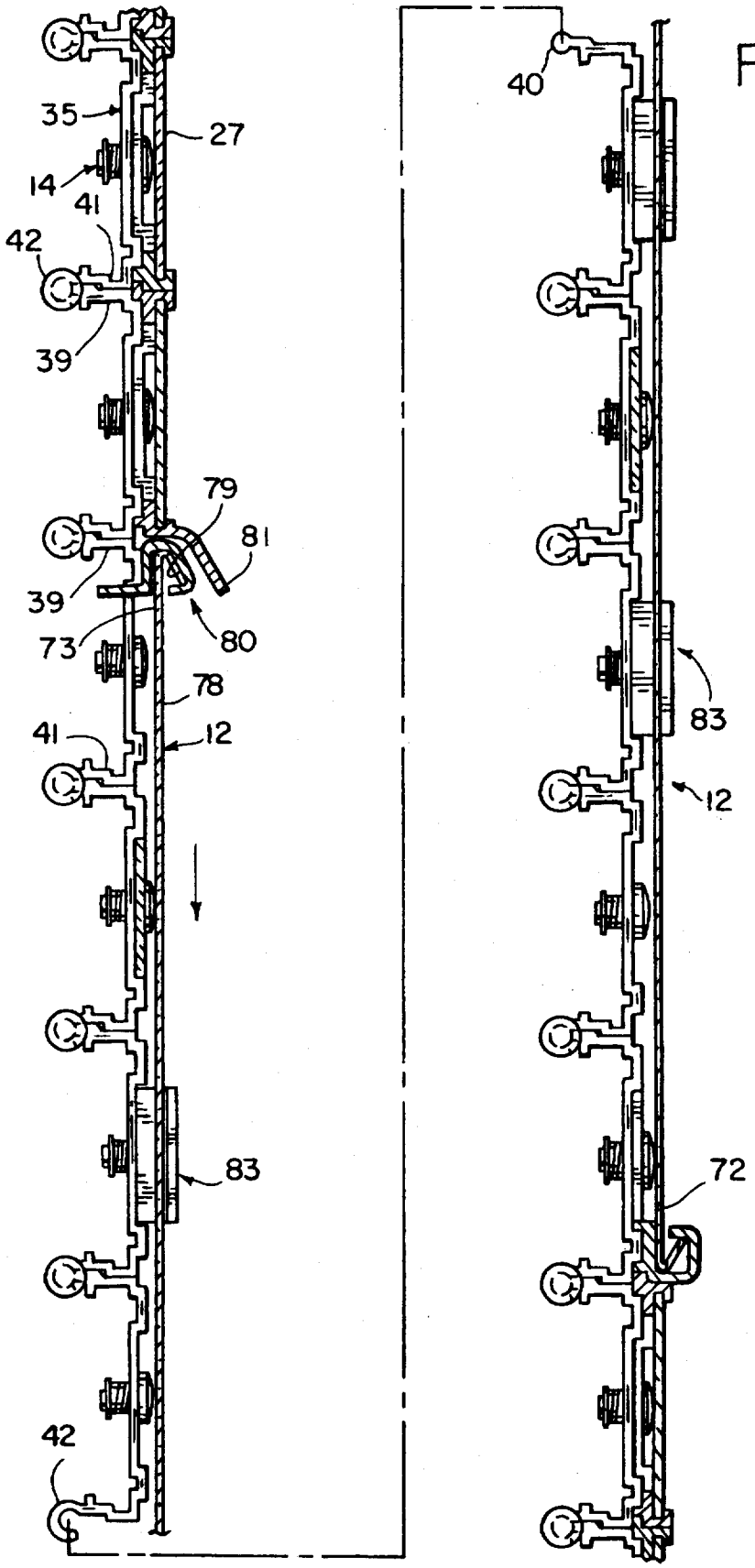
FIG. 4 is a side view of one of the belts showing the leading end of a transparency that is hooked in an extruded member which connects to opposite corresponding links in both belts and shows the trailing end of the transparency having a generally s-shaped stiffener on the short reentrant bend of the transparency which is free to yield lengthwise of the belt as the belt passes over a wheel.

FIG. 2, 4, 5, and 8 show how overcoming the problem of getting the transparency 12 to go around the wheels 19 and 25 without breaking or stretching in spite of the length of the radius R2 extending from the center of wheel to transparency 12 being substantially longer than the radius R1 extending from the wheel center to the pivot point of the link which is coincident with the point of the arrowhead at the end of radius R1 in FIG. 5. Expressed in another way, there is a problem in that any point on the transparency 12 travels through a greater semi-circular distance around the wheel than to the pivot points of the links which support the transparency. The problem is solved as shown in FIGS. 4, 5, and 8 by having only the leading end portion 72 of the transparency 12 secured to the belts 10 and 11 and letting the trailing end portion 73 of the transparency be floating and not attached to the belts. Thus, a reentrant bend 74 is imparted to the leading end portion 72 of the transparency.

A preferably extruded metal elongated retainer, that is indicated in general by the numeral 75, provides for retaining the bent leading end 74 of the transparency and holds it to the belts 10 and 11. One end of the similar ends of hook-shaped retainer 75 appears in FIG. 8. This figure shows the hook-shaped retainer as having an integral tab 76 which has a keyhole comprised of hole 61 and hole 62 that provides for detachably connecting the retainer 75 to corresponding links 35 on opposite belt 10 and 11 using spring biased pins 14 of the links. The retainer 75 is placed on the belts at a place appropriate to where the user wants the transparency to terminate. The longitudinal length of transparencies corresponds closely to the sum of an integer number of belt links.

As shown in FIGS. 2, 4, 5, and 8, the trailing end portion 73 of transparency 12 is terminated with a reentrant bend 79 which is captured in a stiffener member 80. The stiffener member is not attached to either of the belts. It is free floating along with the trailing end of the transparency and serves to guarantee maintenance of the thin transparency in a flat and unbulged condition although it may be that a thick transparency or film as it is otherwise called, might stay flat and unbulged without the stiffener member 80.

As shown in FIGS. 2, 4, 5, and 8 particularly well, the specialized grid 13 preceding the unattached trailing end portion 78 of transparency has an integral bib or hood extending from it which serves as a shade member 81 for precluding any light leaking from between the specialized grid 13 and the transparency stiffener 80 from being visualized by a viewer of the sign which lies outside of the drive wheel 19 or idler wheel 25.

Clips 83 are attached to some belt links 35 and extend over opposite longitudinally extending edges of the transparency 12 to prevent it from bulging. A clip 83 is shown standing by itself in FIG. 8. The clip has a base 84 which has the keyhole combination 61, 62 to provide for attaching base 84 to a belt link 35 using spring biased headed pin 14. The height of the clip is such as to permit the clip to fit between ledges 37 and 38 on a link 35 with little tolerance so the clip cannot turn and misalign. Clip 83 has a generally z-shaped cross sectional configuration defined by an offset portion 85 and a lateral extension or stop member 86.

FIG. 6 shows how the edge of transparency 12 is embraced between the stop member 86 of clip 83 and one of the sides of a belt link 35.

As mentioned earlier, the new roll sign is endowed with the capability of displaying menu items and the like plus transparencies wherever the user wants the transparencies positioned on the belts 10 and 11. The invention, is more easily perceived in FIG. 5 in relation to the problem of a transparency 12 being at a radius R2 from the center of wheel 19 that is greater than the radius R1 from the center of the wheel to the points at which the belt links pivot on the wheel. The latter points coincide with the tip of the arrowhead on R1.

In FIG. 5 it is evident that when the belts 10 and 11 are going around one of the wheels 19 the inward extensions 39 and 41 of two consecutive links simply pivot and diverge or ungulate from each other to allow the rigid links 35 to go around the circular wheel similar to a flexible chain or belt. The gaps between extensions 39 and 41 of consecutive links 35 close after leaving the wheel 19 as is evident from inspection of FIG. 5. However, the transparency 12 having a larger radius R2 would have to stretch or tear to go around the wheel 19 with the rigid links 35, thereby making the use of transparencies in conjunction with rigid information strips 27 but for the invention. However, in accordance with the invention, having the trailing end portion 78 of the transparency free of any connection with the belts 10 and 11, allows a gap 90 to develop so development of tension in transparency 12 is avoided. Although the stiffener member 80 separates from the shade member 81 on specialized grid 13 as the transparency goes around wheel 19, the separation or gap after the trailing end of the transparency closes and light leakage is prohibited when the belts become vertical again as in FIG. 4. A similar gap occurs when the trailing end of the transparency goes around the idler wheel 25.

Although a preferred embodiment of the invention has been described in detail, such description is intended to be illustrative rather than limiting, for the invention may be variously embodied and is to be limited only by interpreting the claims which follow.

We claim:

1. A roll sign comprising:

A first pair of laterally spaced apart wheel members mounted for rotating about a first axis, and a second pair of laterally spaced apart wheel members mounted for rotating about a second axis that is parallel to said first axis, and motor means for driving at least one of the pairs of wheel members rotationally, at least two belts each of which are comprised of a series of pivotally connected links forming closed loops for said belts to run, respectively, on corresponding wheel members in said first and second pairs, a plurality of elongated grid members each having opposite end portions adapted for releasably attaching to corresponding links in each belt, said grid members including means for releasably mounting information strips thereon, a gripping member having opposite end portions adapted for releasably attaching to corresponding links of the belts, said gripping member is adapted to grip a leading end portion of a transparency sheet that has leading end and trailing end portions wherein said leading end portion is the portion that precedes said trailing end portion in the direction in which the sheet translates with the belts, and said trailing end portion of the sheet is free and not connected to a belt.

2. A roll sign comprising:

A first pair of laterally spaced apart wheel members mounted for rotating about a first axis and a second pair of laterally spaced apart wheel members mounted for rotating about a second axis that is parallel to said first axis, and motor means for driving at least one pair of wheel members rotationally, at least two belts for running on corresponding wheel members in each pair, each belt is comprised of a series of links forming a closed loop, the links comprising a body portion having a front side facing in one direction and leg members longitudinally spaced apart and projecting rearwardly in a direction opposite of the direction in which said front side is facing, each leg terminating with a part of a hinge for pivotally connecting to a cooperating different part of a hinge on the other leg of an adjacent link to form said closed loops, a plurality of elongated grid members each having opposite end portions and means on the end portions for releasably attaching the grid members, respectively, to corresponding links on the belts, said grid members including means for releasably mounting information strips thereon, a gripping member having opposite end portions adapted for releasingly attaching to corresponding links of the belts, said gripping member is adapted to grip the leading end of a transparency sheet that has leading and trailing end portions wherein the leading end portion is the portion that precedes the trailing end portion in the direction in which a sheet translates with the belts, and said trailing end portion of the sheet is free and not connected to a belt.

3. A roll sign according to claim 1 including an elongated stiffener member for engaging said trailing end portion of a transparency sheet to prevent bulging of said sheet.

4. A roll sign according to claim 2 including an elongated stiffener member for engaging said trailing end portion of a transparency sheet to prevent bulging of said sheet.

5. A roll sign according to claim 2 wherein said part of a hinge terminating one of said legs of said link is an axle, and said part of a hinge terminating the other of said legs on the link is a laterally extending socket element having a generally c-shaped cross sectional configuration providing an inside opening into which said axle is disposed for hingedly connecting one link to another and having a substantially cylindrical outside surface providing pivot points for a link, the wheel members in a said rotationally driven wheel member pair each having a periphery containing circumferentially equally spaced apart recesses that are spaced apart by substantially the distance between said pivot points on said socket elements for said legs to extend radially inwardly to the recesses and for said socket elements on said legs of each link to register in said recesses to effect translating said belts, said links and legs are composed of rigid material and said body portions of said links, respectively, are at a radial distance from the axis of said wheel members substantially equal to the sum of a first radial distance from said axis to a said recess plus the radial length of said legs to said body portions such that the legs on adjacent links angulate apart from each other to compensate for the increase in circumferential distance through which the said body portions of said links must translate when said belts are running over said wheel members.

6. A roll sign according to any one of claims 1, 2, 3, 4 or 5 wherein a transparency sheet that is to be translated by said belts has laterally spaced apart and longitudinally extending side edges and clips mounted to said belts are provided for engaging said side edges to prevent said sheet from bulging, each of said clips having a generally z-shaped configuration a portion of which is adapted for releasably attaching to selected links that are adjacent the side edges of a transparency sheet with a part of a clip overhanging the side edges of a transparency sheet to prevent the transparency sheet from bulging.

7. A roll sign according to any one of claims 1 or 2 including stabilizing bar members having opposite end portions and means for releasably attaching said opposite end portions, of said stabilizing bar members, respectively, to corresponding links on said belts, said stabilizing bar members are attached periodically along said belts for maintaining uniform spacing between belts.

8. A roll sign according to any one of claims 1 or 2 including means for releasably attaching a said end portion of said gripping member to a link of said belt, said link and said end portion of the gripping member each having front and rear surfaces, wherein:

a selected one of said end portion or said link has a keyhole extending from its front surface to its rear surface and the keyhole is composed of two intersecting holes, one of which is larger than the other, a selected other of said end portion or said link having an aperture and an attachment pin comprised of a shank extending through said aperture and beyond one of said surfaces with said head disposed adjacent the opposite one of said surfaces, a spring on said shank for urging said head toward said opposite one of said surfaces, the larger of the intersecting holes having a diameter sufficiently larger to pass with small clearance over the head of the pin for said opposite surfaces on the link and said end portion of said gripping member to interface, the smaller of the intersecting holes having a diameter which is at least as large as the diameter of the shank and smaller than the diameter of the head, shifting said gripping member laterally when said surfaces are interfaced causing said smaller hole to slide under said head to releasably attach the gripping member to the link.

9. A roll sign according to claim 6 including means for releasably attaching a said clip for preventing bulging of said transparency sheet to a link in said belt, said link and said portion of the clip each having front and rear surfaces, wherein:

a selected one of said portion of said clip or said link has a keyhole extending from its front surface to its rear surface and the keyhole is composed of two intersecting holes, one of which is larger than the other, a selected other of said portion or said link having an aperture and an attachment pin comprised of a shank extending through said aperture and beyond one of said surfaces with said head disposed adjacent to the opposite one of said surfaces, a spring on said shank for urging said head toward said opposite one of said surfaces, the larger of the intersecting holes having a diameter sufficiently large to pass with small clearance over the head of the pin for said opposite surfaces on the link and said portion of the clip to interface, the smaller of the intersecting holes having a diameter which is at least as large as the diameter of the shank and smaller than the diameter of the head, shifting said clips laterally when said surfaces are interfaced causing said smaller hole to slide under said head to releasably attach the clip to the link.

10. A roll sign according to any one of claims 3 or 4 wherein a said grid member that is releasably attached at its opposite end portions to corresponding links of the belts has a shading element projecting therefrom and is arranged in the series of links comprising the belts such that the shading element overhangs a said stiffener element on said trailing end of a transparency sheet to prevent a viewer of the sign from visualizing leakage light above said trailing end of a transparency when said belts are in downward run.

11. A roll sign according to any one of claims 1 or 2 wherein:

a selected one of said grid member or said link has a keyhole extending therethrough, the keyhole being composed of two intersecting holes one of which holes is larger in diameter than the other of the holes, a selected other than said selected one of said grid member or said link having an aperture of predetermined diameter therethrough, the diameter of said aperture being smaller than the diameter of either of said holes composing said two intersecting holes of said keyhole, an attachment pin for attaching one of said grid member and said link to the other of said grid member or said link, said attachment pin comprising a cylindrical shank having a diameter and having a free end and a head at an end of the shank opposite from said free end, said shank extending through said aperture in said selected other than said selected one of said grid member or said link, said head having a diameter greater than the diameter of said aperture and slightly smaller than the diameter of said larger of said holes composing said keyhole, a retainer element fixed on said free end of said shank of said attachment pin and a spring interposed between said retainer element and said selected other than said selected one of said grid member or said link for biasing said head of said attachment pin yieldingly toward said selected other than said selected one of said grid member and said link to provide for passing said larger hole of the keyhole over said head of said pin when said grid member and said link are interfaced and then sliding one or the other of said grid member or said link relative to the other in opposition to the bias of said spring until said smaller of said holes composing said keyhole is positioned on said shank of said pin under said head of the pin to thereby attach said grid member and said link together.

* * * * *